US008320597B2

(12) United States Patent
Griffin, Jr. et al.

(10) Patent No.: US 8,320,597 B2
(45) Date of Patent: Nov. 27, 2012

(54) ACOUSTIC DOCK FOR PORTABLE ELECTRONIC DEVICE

(75) Inventors: Paul P. Griffin, Jr., Nashville, TN (US); Benjamin T. Guy, Nashville, TN (US); George Anderson Cook, Nashville, TN (US)

(73) Assignee: Griffin Technology, Inc., Nashville, TN (US)

( * ) Notice: Subject to any disclaimer, the term of this patent is extended or adjusted under 35 U.S.C. 154(b) by 539 days.

(21) Appl. No.: 12/357,400

(22) Filed: Jan. 22, 2009

(65) Prior Publication Data

US 2010/0183179 A1 Jul. 22, 2010

(51) Int. Cl.
*H04R 1/34* (2006.01)
*H04R 1/30* (2006.01)
*G10K 11/02* (2006.01)

(52) U.S. Cl. ..... 381/339; 381/340; 381/341; 181/179; 379/444; 379/455

(58) Field of Classification Search ..... 381/337, 381/338, 339, 340, 341; 181/0.5, 21, 177, 181/179; 379/441, 444, 447, 450, 457, 454, 379/455

See application file for complete search history.

(56) References Cited

U.S. PATENT DOCUMENTS

| | | | | |
|---|---|---|---|---|
| 5,703,946 | A * | 12/1997 | Chen | 379/446 |
| 5,778,062 | A * | 7/1998 | Vanmoor | 379/433.11 |
| 5,890,072 | A * | 3/1999 | Rabe | 455/550.1 |
| 2002/0009195 | A1* | 1/2002 | Schon | 379/454 |

FOREIGN PATENT DOCUMENTS

| | | | |
|---|---|---|---|
| GB | 2377116 A | * | 12/2002 |
| JP | 2005136895 A | * | 5/2005 |
| JP | 2005184050 A | * | 7/2005 |

OTHER PUBLICATIONS

English translation of JP 2005-184050 A, accessed Jul. 25, 2011.*

* cited by examiner

*Primary Examiner* — Jeremy Luks
(74) *Attorney, Agent, or Firm* — HornKohl Intellectual Property Law, PLLC; Jason L. HornKohl

(57) ABSTRACT

An accessory for a portable electronic device having a speaker uses an acoustic wave guide to passively amplify and direct the output of the device's speaker. The accessory has a housing with a docking cavity formed therein. The docking cavity has supportive sidewalls that are adapted to receive and support the portable electronic device in an upright position. A cable access channel is formed in the docking cavity that allows a connector and cable to be coupled to the portable electronic device when the portable electronic device is mounted in the docking cavity. An acoustic waveguide having a spiral shaped acoustic chamber is positioned in the housing such that an entrance to the acoustic waveguide corresponds to a hole in the docking cavity that is positioned to correspond to the location of the speaker of the device when the device is mounted in the docking chamber. The exit of the acoustic chamber corresponds to an exterior opening in a sidewall of the housing and the hole in the docking cavity. The housing can be provided with charging circuitry to charge the device when the device is mounted in the dock.

14 Claims, 6 Drawing Sheets

ACOUSTIC DOCK FOR PORTABLE ELECTRONIC DEVICE

CROSS-REFERENCES TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Many portable electronic devices have speakers whose acoustic output level is lower than most users would prefer. This acoustic output problem arises from a number of issues unique to portable electronic devices. First, the power available for the device is from preferably a portable power supply such as a rechargeable lithium ion battery. Since the device is designed to be portable and often carried in the pocket of a user, the size of the battery, and thus the power available, is limited. The more powerful the audio output, the greater the drain on the battery. Also, the size of the speaker and its acoustic amplifier is limited by the desire to make the devices as small and portable as possible.

External speakers and electronic amplifiers for portable electronic devices are available. Unfortunately, these electronic amplifiers require external power or are parasitic devices that drain power from the power supply of the device. In addition, these electronic amplifiers require relatively complex electronic components and are subject to malfunctioning due to short or open circuits in the electronic components.

In light of the above discussed problems with the prior art, what is needed is an improved device and method for increasing the audio output of a portable electronic device.

BRIEF SUMMARY OF THE INVENTION

An embodiment of the present invention is directed toward an acoustic amplifier for use with a portable electronic device having a display, a user input and an audio output that produces audible frequency sound waves. The acoustic amplifier includes a dock for the portable electronic device having a docking chamber with supportive sidewalls that support the device such that the display is visible and the user input accessible when the device is mounted in the dock. The amplifier has an enclosed housing with the dock constructed on an upper surface of the housing. An acoustic waveguide having an input is positioned in the enclosed housing. An opening in the dock corresponds to an entrance of the waveguide and the audio output of the portable electronic device when the device is mounted in the dock such that the audio output is amplified by the acoustic waveguide. The acoustic waveguide has a spiral configuration with a perpendicular cross section that increases substantially exponentially from the entrance to an exit of the acoustic waveguide. A cable access slot is preferably formed in the dock cavity that allows a cable to be coupled to a connector of the portable electronic device when the device is mounted in the dock. The housing preferably consists essentially of an upper molded portion and a lower molded portion.

Another embodiment of the present invention is directed toward an accessory for a portable electronic device having a speaker. The accessory includes a housing having a docking cavity formed therein wherein the docking cavity has supportive sidewalls that are adapted to receive and support the portable electronic device in an upright position. A cable access channel formed in the docking cavity that allows a connector and cable to be coupled to the portable electronic device when the portable electronic device is mounted in the docking cavity. An acoustic waveguide having a spiral shaped acoustic chamber is positioned in the housing such that an entrance to the acoustic waveguide corresponds to a hole in the docking cavity that is positioned to correspond to the location of the speaker of the device when the device is mounted in the docking chamber. The entrance to the acoustic chamber preferably has a cross sectional area is approximately the same size as a surface area of the speaker of the device. The exit of the acoustic chamber waveguide corresponds to an exterior opening in a sidewall of the housing. A perpendicular cross sectional area of the acoustic chamber increases approximately exponentially from the acoustic chamber entrance to the acoustic chamber exit. The accessory includes an external power supply connection adapted to receive power from an external power supply, charging circuitry for converting the received power to a charging voltage and an electrical connector in the docking cavity for coupling the charging voltage to the portable electronic device when the portable electronic device is mounted in the docking cavity. The housing and the acoustic wave guide are preferably constructed from a translucent polycarbonate plastic formed into a unitary molded upper portion and a unitary molded lower portion.

BRIEF DESCRIPTION OF THE SEVERAL VIEWS OF THE DRAWINGS

FIG. 1(*b*) is an illustration of the acoustic waveguide dock of FIG. 1(*a*) having the mobile phone mounted in the dock;

DETAILED DESCRIPTION OF THE INVENTION

The present invention is directed toward a charging, acoustic amplifier for a portable electronic device that turns the device into a no-power-drain sound system that never needs batteries or adapters.

An acoustic waveguide is a physical structure for guiding sound waves. The duct contains air that supports sound propagation. One example of an acoustic wave guide is a stethoscope. The length of the wave guide is normally of a similar order as the wavelengths of the sound it will be used with, but the dimensions of its cross section are normally smaller than one quarter of the target wavelength. Sound is introduced at one end of the tube by forcing the pressure across the whole cross-section to vary with time. A plane wave will travel down the line at the speed of sound. When the wave reaches the end of the transmission line, behavior depends on what is present at the end of the line.

Figure 1A:
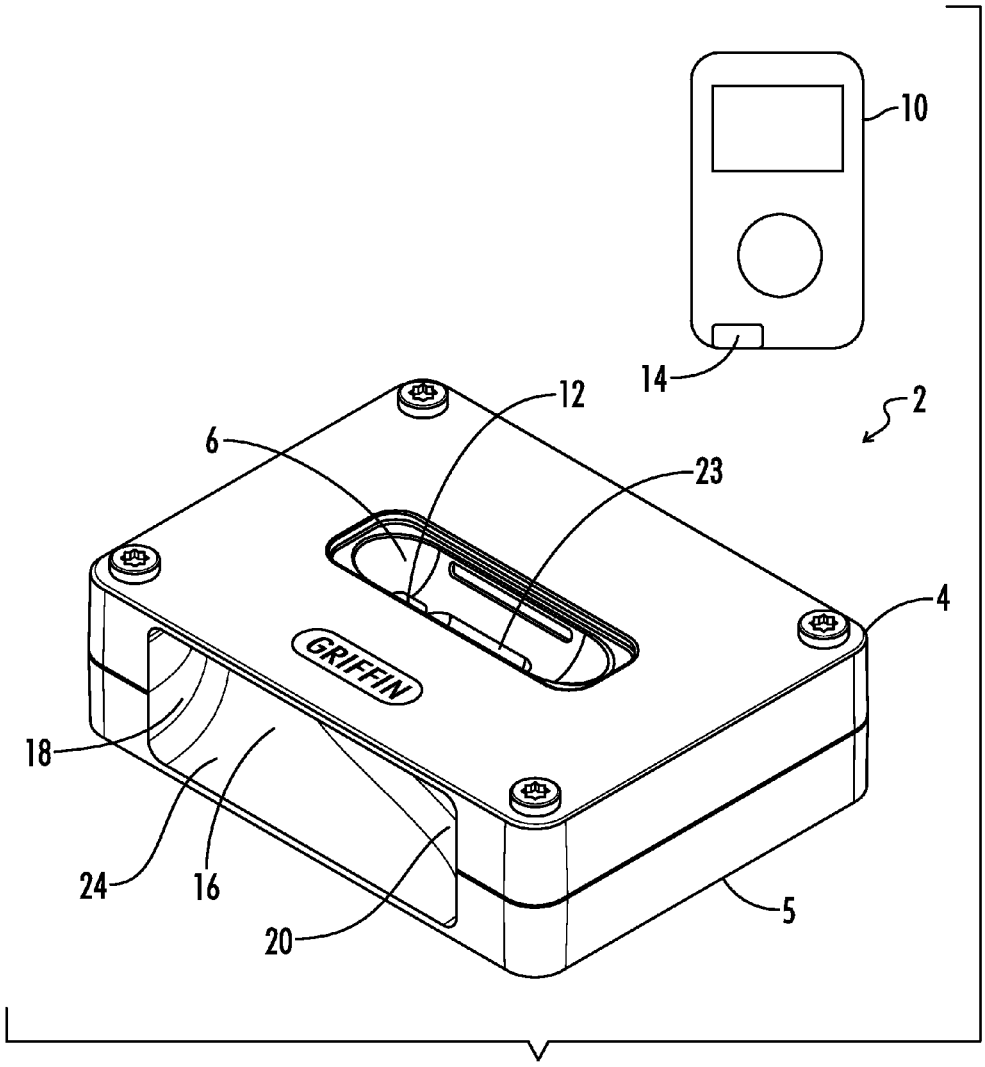
FIG. 1(*a*) is an illustration of an acoustic waveguide dock adapted to amplify an acoustic output of a mobile phone.
Figure 1B:
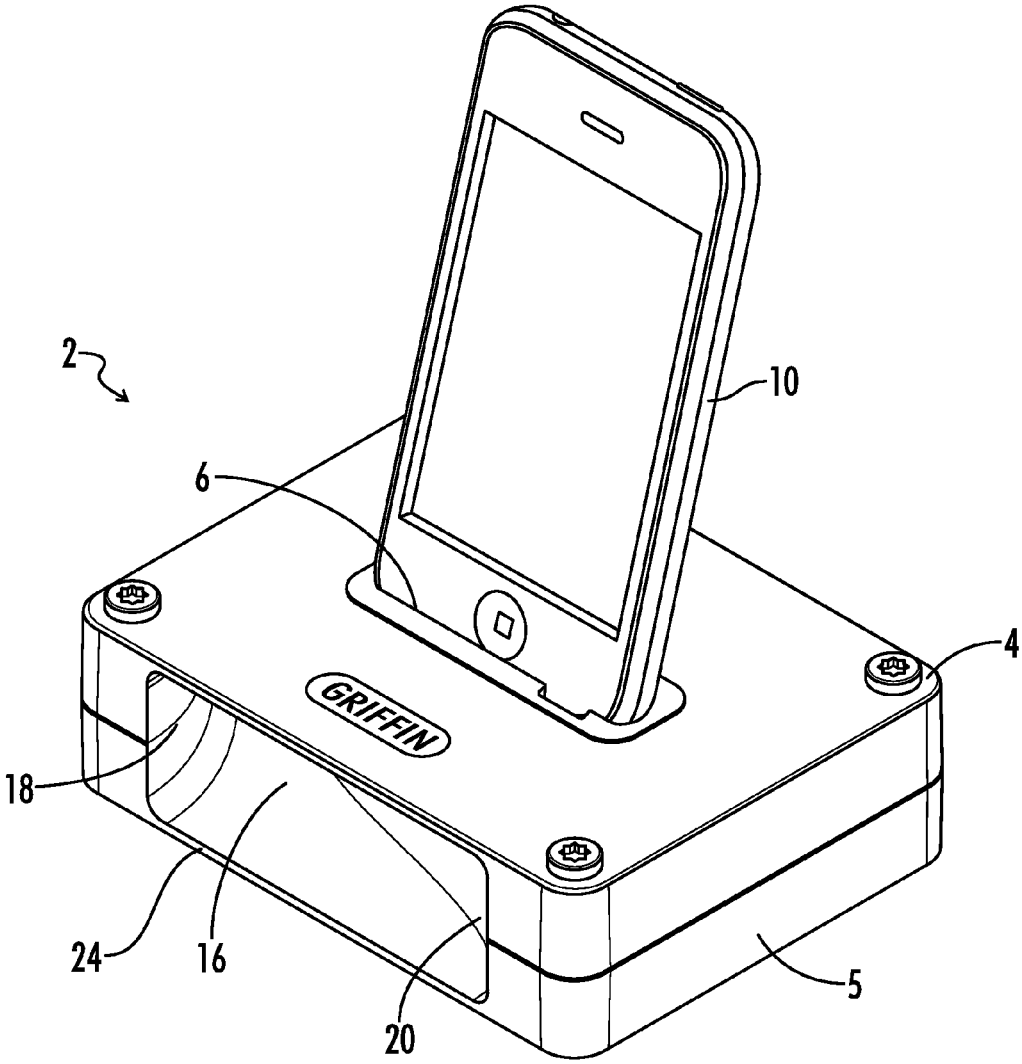

Referring now to FIG. 1(A), an illustration of an acoustic wave guide constructed in accordance with an embodiment of the present invention is shown. The embodiment 2 consists of a rectangular housing 4 having a dock 6 formed in the top. While the housing shown 4 is rectangular, any shape exterior can be used. The dock 6 is configured to couple the housing 4 to a portable electronic device 10. The housing preferably 4 has a flat base 5 so that the portable electronic device 10 can be held in an upright position without tipping the housing 4. Mounting the device 10 in an upright position allows the display of the device to be seen and the user controls accessed while the device 10 is mounted in the dock. FIG. 1(B) is an illustration of the embodiment of FIG. 1(A) wherein the device 10 is mounted in the dock 6.

A hole 12 in the housing 4 corresponds to a position of a speaker 14 on the portable device 10 when the device is mounted in the dock 6. The hole 12 couples the speaker 14 output to a coiled waveguide 16 formed in the housing and shown in more detail in the exploded view of FIG. 2. The coiled wave guide 16 is formed from curved sidewalls 18 and 20 that form an expanding chamber that terminates in an opening 24 in the housing 4. The wave guide 16 represented in FIGS. 1 and 2 amplifies the output of the speaker by about 10 decibels and projects it in the direction of the opening 24. This allows the audio output to be directed toward a particular location by a user. The wave guide is preferably mathematically designed as described herein below.

The dock 6 and housing 4 have a pass-through slot 23 constructed in therein that allows a dock cable to be fed through the housing 4 to the device 10 while the device is mounted in the dock 6. This allows the device 10 to be charged or remotely accessed by a computer while mounted in the dock 6.

The housing 4 and waveguide 16 are preferably constructed from a translucent polycarbonate that allows a user to see the graceful curves of the waveguide that are mathematically designed to amplify the sound output of the device. Most preferably, the housing is constructed from an upper and lower molded polycarbonate portions that are connected with four screws located in the corners of the housing 2 as shown in FIG. 3.

Figure 2:
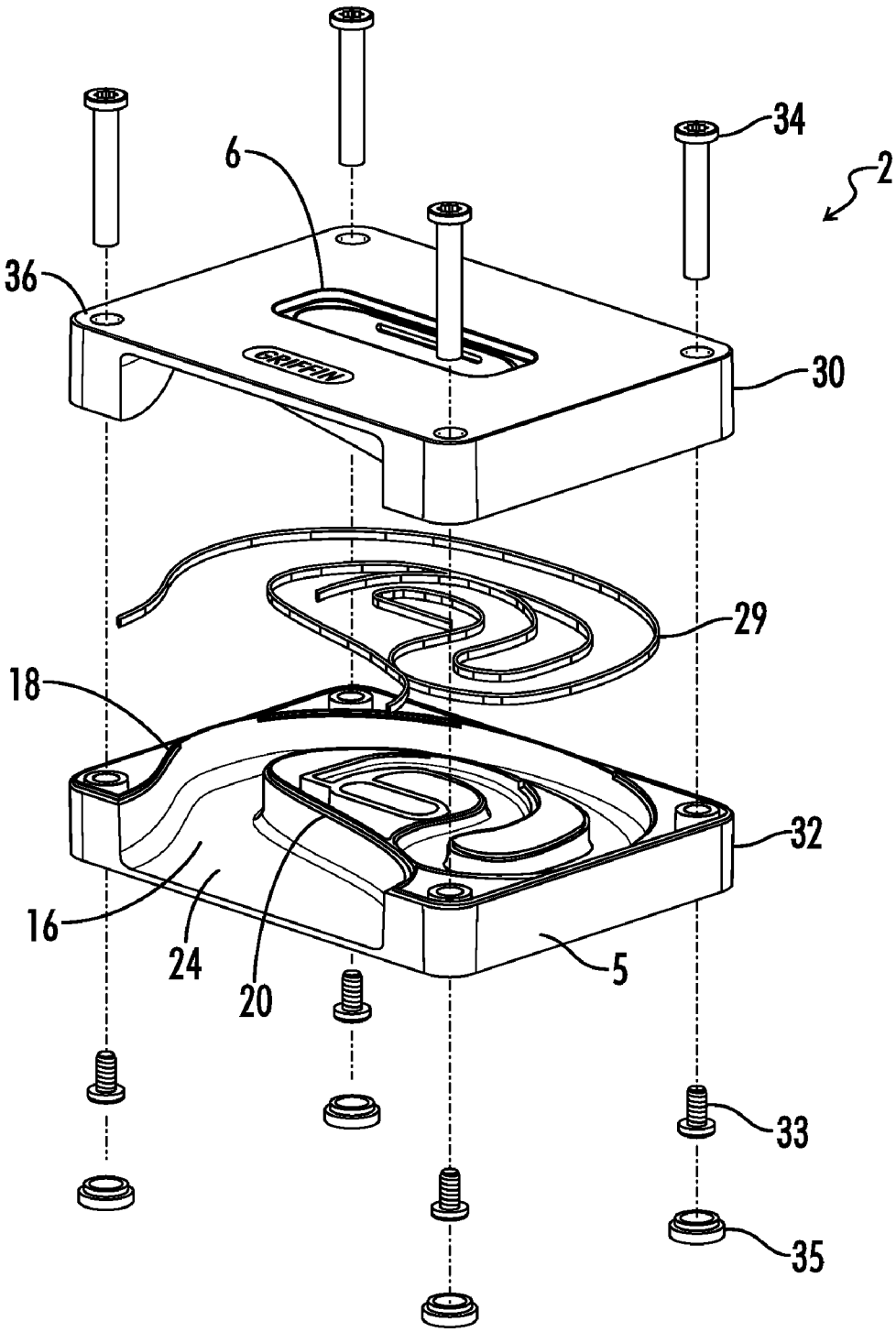
FIG. 2 is an exploded illustration of the acoustic waveguide dock of FIG. 1.

FIG. 2 is an exploded illustration of the acoustic waveguide dock of FIG. 1. As shown in the figure, the housing 4 is constructed from upper 30 and lower 32 molded pieces that are connected with four bolts 34 positioned at the corners. A gasket 29 is used to mate the upper 30 and lower 32 portions and seal the coiled wave guide 16. The bolts 34 are inserted through corresponding holes 36 in the upper and lower pieces 30 and 32 and mate with screws 33. Foot pads 35 help the housing 4 grip the surface on which the device 2 is resting. The simple two piece construction is both economical and visually appealing.

Figure 3:
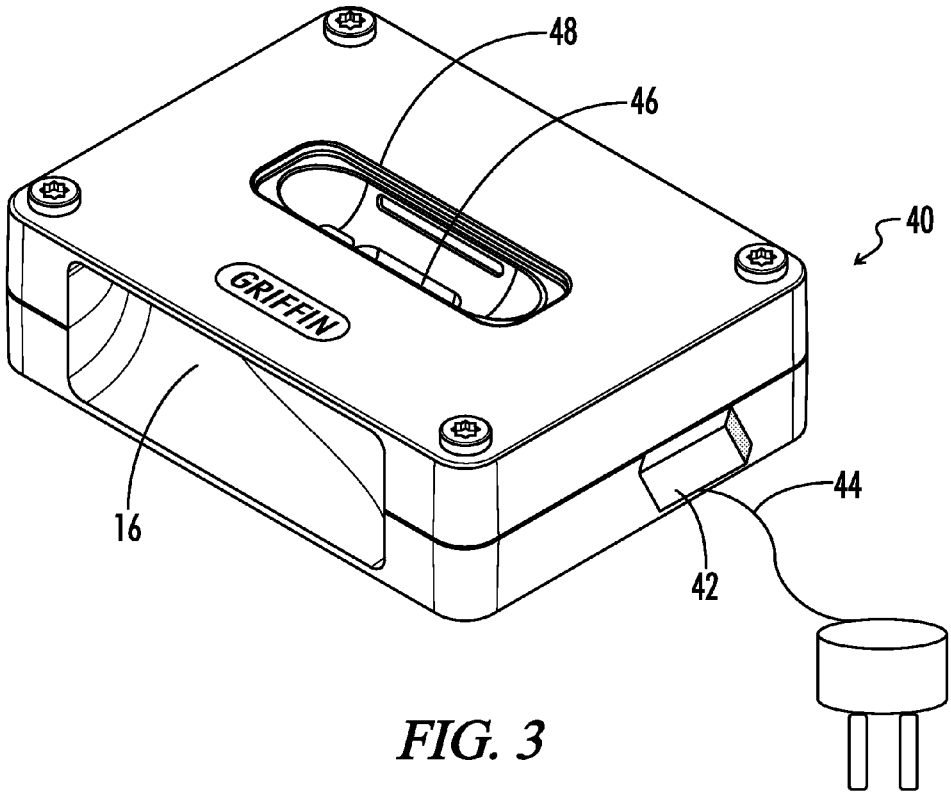
FIG. 3 is an illustration of an acoustic waveguide dock having charging circuitry.

FIG. 3 is an illustration of an acoustic waveguide dock 40 having charging circuitry 42 constructed in accordance with an embodiment of the present invention. The embodiment is the same as that shown in FIG. 1 except that, in the embodiment of FIG. 3, charging circuitry 42 and an external power supply connection 44 are included in the housing 46 of the wave guide dock 40. In addition, a connector 46 is provided in the docking cavity 48 that couples to a device when it is mounted on the acoustic waveguide dock 40 so that device can be charged while it is mounted in the acoustic dock. Although the embodiment of FIG. 3 allows the device to be charged by the dock, the passive waveguide embodiment of FIGS. 1 and 2 may be preferred in many circumstances in that it requires no power and can be simply and inexpensively constructed without any electronic components. In addition, if the acoustically amplifying dock is only constructed from passive components, it is exceptionally durable and unlikely to break or malfunction.

Figure 4:
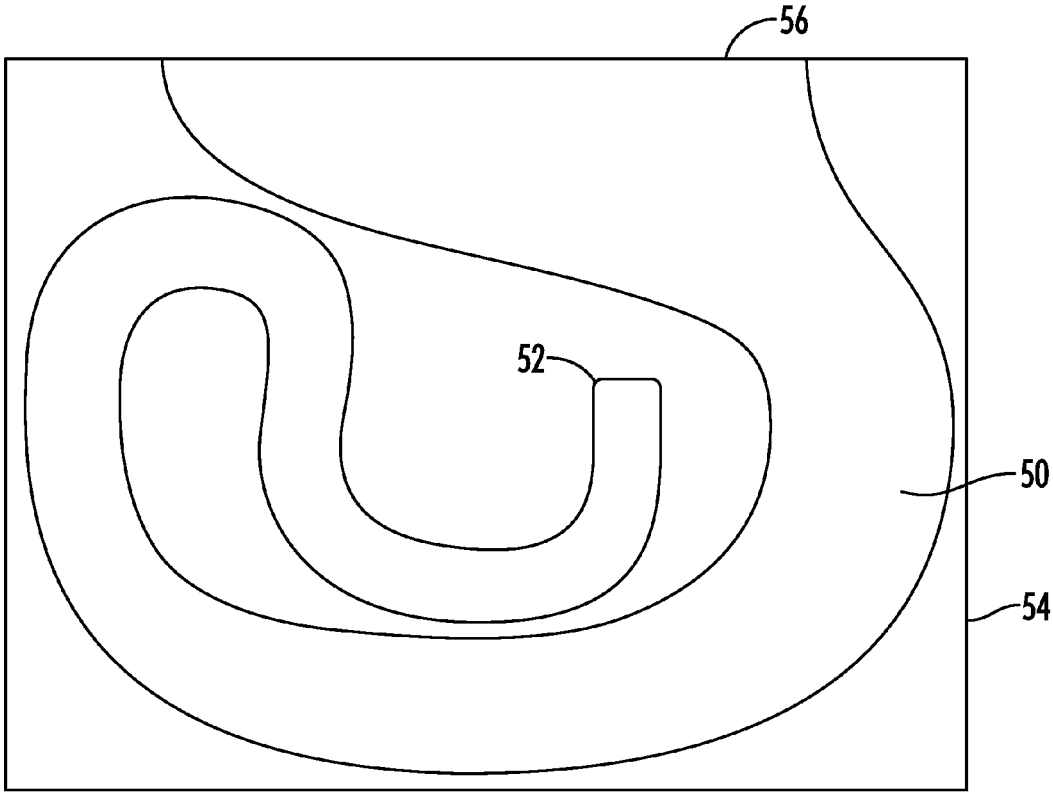
FIG. 4 is an illustration of an air horn inside a docking chamber constructed in accordance with an embodiment of the present invention.

Referring now to FIG. 4, an illustration of an air horn inside a docking housing constructed in accordance with an embodiment of the present invention is shown. The air horn 50 is constructed in a housing 54 and has a horn entrance 52 that is positioned to correspond to the opening in the docking chamber on the top of the housing 54 discussed above. The precise positioning of the entrance 52 is defined by the position of the speaker of the device mounted don the housing 54. The air horn 50 also has a mouth or exit 56 formed in the walls of the housing 54. In the example shown, the housing 54 has a width of 121 mm and a length of 91.5 mm.

The air horn is preferably designed such that the perpendicular cross sectional area of the horn 50 increases exponentially proceeding from the horn entrance 52 to the horn exit 56. The cross sectional area of the horn entrance 52 is selected to approximately correspond to the area of the speaker of the device mounted in the dock on the housing 54. The horn exit 56 is preferably selected to have a cross sectional area that is substantially the same size as the exterior face of the housing 54 on which the horn exit 56 is positioned. The horn 50 is then designed to curve through the housing 54 such that it's perpendicular cross sectional increases approximately exponentially from the horn entrance 52 to the horn exit 56.

Figure 5:
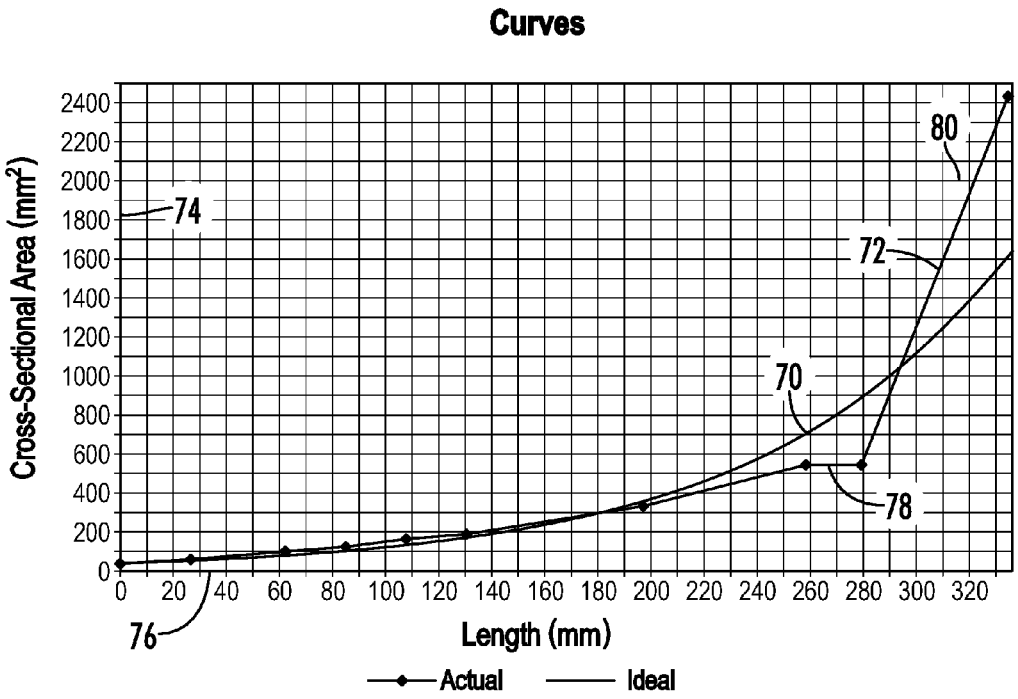
FIG. 5 is a graph of an ideal air horn cross sectional area along the length of an air horn and an actual cross sectional area of the air horn of FIG. 4.

Referring now to FIG. 5, a graph of an ideal air horn cross sectional area 70 along the length of an air horn and an actual cross sectional area 72 of the particular air horn design of FIG. 4. The cross sectional area of the air horn is displayed on the vertical axis 74 and the length of the air horn is plotted on the horizontal axis 76. The ideal cross sectional area 70 increases exponentially along the length 74 of the horn. The particular exponential function is $f(x)=41e^{x}$ for the ideal cross sectional area 70 shown. Nevertheless, an effective air horn can be designed using almost any exponentially increasing function.

Due to the constraints imposed upon the air horn design of FIG. 4 by the size of docking housing in which the air horn is constructed, the actual air horn cross sectional area 72 is less than the exponential ideal 70 in some areas 78 and greater than the ideal 70 in other areas 80 along its length. The precise design of the air horn may also be influenced by a number of other factors such as the need to connect a charging cable to a device mounted on the housing and the need to accommodate a docking chamber on the housing.

What is claimed is:

1. An accessory for a portable electronic device having a speaker, said accessory comprising:

a rectangular, box-shaped housing having a docking cavity formed in an upper face of an exterior wherein the docking cavity has supportive sidewalls that are adapted to receive and support the portable electronic device in an upright position;

a cable access channel formed in the docking cavity that allows a connector and cable to be coupled to the portable electronic device when the portable electronic device is mounted in the docking cavity; and an acoustic waveguide having a spiral shaped acoustic chamber positioned in the rectangular, box-shaped housing such that an entrance to the acoustic waveguide corresponds to a hole in the docking cavity that is positioned to correspond to the location of the speaker of the device when the device is mounted in the docking cavity;

wherein a perpendicular cross sectional area of said acoustic chamber increases approximately exponentially from the acoustic chamber entrance to the acoustic chamber exit; and wherein an exit of said acoustic waveguide is substantially the same size as an exterior face of said rectangular, box-shaped housing on which said exit is positioned.

2. The accessory of claim 1 further comprising an external power supply connection adapted to receive power from an external power supply, charging circuitry for converting the received power to a charging voltage and an electrical connector in the docking cavity for coupling the charging voltage to the portable electronic device when the portable electronic device is mounted in the docking cavity.

3. The accessory of claim 1 wherein said housing and said acoustic waveguide are constructed from a translucent polycarbonate plastic.

4. The accessory of claim 1 wherein the entrance to the acoustic chamber has a cross sectional area that is approximately the same size as a surface area of the speaker of the device.

5. The accessory of claim 1 wherein the housing and the waveguide consist essentially of a unitary molded upper portion and a unitary molded lower portion.

6. A dock for a portable electronic device having an audio output that produces audible frequency sound waves; said dock comprising:

an acoustic waveguide having an input positioned on said dock to correspond to said audio output of said portable electronic device when said portable electronic device is mounted on said dock such that said audio output is amplified;

a rectangular, box-shaped housing having a docking cavity formed in an upper face wherein the docking cavity has supportive sidewalls that are adapted to receive and support, the portable electronic device in an upright position;

wherein a perpendicular cross sectional area of the acoustic waveguide increases substantially exponentially from a entrance to the acoustic waveguide to an exit of the acoustic wave guide; and wherein said exit of said acoustic waveguide is substantially the same size as an exterior face of said rectangular box shaped housing on which said exit is positioned.

7. The dock of claim 6 wherein said acoustic wave guide has a spiral configuration.

8. The dock of claim 6 further comprising an external power supply connection, charging circuitry for converting a voltage received from the external power supply connection to a charging voltage and a connector for coupling said charging voltage to the portable electronic device.

9. The dock of claim 6 further comprising a docking cavity that couples with a housing of the portable electronic device wherein the docking cavity has a hole formed therein to couple the audio output of the portable electronic device to the acoustic waveguide.

10. The dock of claim 6 further comprising a cable access slot formed in the docking cavity that allows a cable to be coupled to a connector of the device when the device is mounted in the docking cavity.

11. An acoustic amplifier for use with a portable electronic device having a display, a user input and an audio output that produces audible frequency sound waves; said acoustic amplifier comprising:

a rectangular, box-shaped housing having a docking cavity formed in an upper face wherein the docking cavity has supportive sidewalls that are adapted to receive and support the portable electronic device in an upright position;

an acoustic waveguide positioned in said rectangular, box-shaped housing;

an opening in said docking cavity that corresponds to an entrance of said acoustic waveguide and said audio output of said portable electronic device when said device is mounted in said dock such that said audio output is amplified by said acoustic waveguide;

wherein said acoustic wave guide has a spiral configuration with a perpendicular cross section that increases substantially exponentially from said entrance to an exit of said acoustic waveguide; and wherein said exit of said acoustic waveguide is substantially the same size as an exterior face of said rectangular, box-shaped housing on which said exit is positioned.

12. The acoustic amplifier of claim 11 further comprising an external power supply connection, charging circuitry for converting a voltage received from the external power supply connection to a charging voltage and a connector for coupling said charging voltage to the portable electronic device.

13. The acoustic amplifier of claim 11 further comprising a cable access slot formed in the dock cavity that allows a cable to be coupled to a connector of the portable electronic device when the device is mounted in the dock.

14. The acoustic amplifier of claim 11 wherein said housing consists essentially of an upper molded portion and a lower molded portion.

* * * * *